US010415394B2

(12) United States Patent
Slavens et al.

(10) Patent No.: US 10,415,394 B2
(45) Date of Patent: Sep. 17, 2019

(54) GAS TURBINE ENGINE BLADE WITH CERAMIC TIP AND COOLING ARRANGEMENT

(71) Applicant: UNITED TECHNOLOGIES CORPORATION, Farmington, CT (US)

(72) Inventors: Thomas N. Slavens, Vernon, CT (US); Mosheshe Camara-Khary Blake, Manchester, CT (US); Timothy J. Jennings, South Windsor, CT (US); Nicholas M. LoRicco, Coventry, CT (US); Sasha M. Moore, East Hartford, CT (US); Clifford J. Musto, West Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 503 days.

(21) Appl. No.: 15/102,890

(22) PCT Filed: Dec. 2, 2014

(86) PCT No.: PCT/US2014/068072

§ 371 (c)(1),
(2) Date: Jun. 9, 2016

(87) PCT Pub. No.: WO2015/094636

PCT Pub. Date: Jun. 25, 2015

(65) Prior Publication Data

US 2016/0312617 A1 Oct. 27, 2016

Related U.S. Application Data

(60) Provisional application No. 61/916,417, filed on Dec. 16, 2013.

(51) Int. Cl.
*F01D 5/14* (2006.01)
*F01D 5/18* (2006.01)
(Continued)

(52) U.S. Cl.
CPC ..... *F01D 5/147* (2013.01); *F01D 5/187* (2013.01); *F01D 5/20* (2013.01); *F01D 5/284* (2013.01);
(Continued)

(58) Field of Classification Search
CPC ..... F01D 5/147; F01D 5/186; F01D 5/187; F01D 5/20; F01D 5/284; B60B 7/02
See application file for complete search history.

(56) References Cited

U.S. PATENT DOCUMENTS 7,963,745 B1 6/2011 Liang
2002/0141868 A1* 10/2002 Lee ..... C23C 28/00 416/97 A
(Continued)

FOREIGN PATENT DOCUMENTS

EP 1607578 A1 12/2005
EP 2620240 7/2013

OTHER PUBLICATIONS

International Search Report and Written Opinion for PCT Application No. PCT/US2014/068072, dated Mar. 27, 2014.
(Continued)

*Primary Examiner* — Woody A Lee, Jr.
(74) *Attorney, Agent, or Firm* — Carlson, Gaskey & Olds, P.C.

(57) ABSTRACT

A blade for a gas turbine engine includes an airfoil that extends a span from a root to a tip. The airfoil is provided by a first portion near the root and has a metallic alloy. A
(Continued)

third portion near the tip has a refractory material. A second portion joins the first and third portions and has a functional graded material.

16 Claims, 2 Drawing Sheets

(51) Int. Cl.
*F01D 5/20* (2006.01)
*F01D 5/28* (2006.01)

(52) U.S. Cl.
CPC .... *F05D 2230/30* (2013.01); *F05D 2260/202* (2013.01); *F05D 2300/13* (2013.01); *F05D 2300/17* (2013.01); *F05D 2300/6031* (2013.01); *F05D 2300/6033* (2013.01)

(56) References Cited

U.S. PATENT DOCUMENTS

2006/0166019 A1* 7/2006 Spitsberg ..... C04B 41/009 428/471
2009/0208343 A1* 8/2009 Cunha ..... F01D 5/187 416/97 R
2010/0226782 A1* 9/2010 Eichmann ..... F01D 5/28 416/241 B
2011/0097213 A1* 4/2011 Peretti ..... B23P 15/04 416/241 A
2011/0123311 A1* 5/2011 Devore ..... F01D 5/187 415/115
2011/0143042 A1* 6/2011 Peretti ..... B23K 9/04 427/455
2011/0217568 A1 9/2011 Parekk et al.
2013/0170963 A1* 7/2013 Mironets ..... F01D 11/12 415/173.1
2013/0251536 A1* 9/2013 Mironets ..... F01D 5/147 416/229 A
2013/0315748 A1 11/2013 Lacy et al.
2014/0037981 A1* 2/2014 Cui ..... B22D 27/045 428/615
2015/0247245 A1* 9/2015 Wali ..... F01D 25/005 416/241 B

OTHER PUBLICATIONS

International Preliminary Report on Patentability for PCT Application No. PCT/US2014/068072, dated Jun. 30, 2016.
The Supplementary Partial European Search Report for EP Application No. 14871481, dated Sep. 27, 2017.

* cited by examiner

GAS TURBINE ENGINE BLADE WITH CERAMIC TIP AND COOLING ARRANGEMENT

CROSS-REFERENCE TO RELATED APPLICATIONS

This application claims priority to U.S. Provisional Application No. 61/916,417, which was filed on Dec. 16, 2013 and is incorporated herein by reference.

BACKGROUND

This disclosure relates to a gas turbine engine blade and its cooling configuration.

A gas turbine engine uses a compressor section that compresses air. The compressed air is provided to a combustor section where the compressed air and fuel is mixed and burned. The hot combustion gases pass over a turbine section to provide work that may be used for thrust or driving another system component.

The construction and fabrication of airfoils for use in gas turbine applications are an extremely costly endeavor. Typically turbine blades and vanes are constructed through investment casting processes that utilize a core within a shell in which molten metal is poured and solidified. Due to the extremely harsh environment in which turbine airfoils typically operate, superalloys are typically employed due to their superior strength at high temperature. Single crystal nickel alloys are often used at high pressure turbine locations to allow for extended operation at high temperatures with low risk of creep failures due to the combination of high centrifugal loads and high temperatures. Further, most airfoils in these environments are actively cooled, requiring intricate interior cooling configurations that route cooling air through the airfoil.

The advancement of additive manufacturing to create metal parts enables for extremely detailed, intricate and adaptive feature designs. The ability to utilize this technology not only increases the design space of the parts but allows for a much higher degree of manufacturing robustness and adaptability. It enables the elimination of costly manufacturing tooling and only requires three dimensional definition of the part. However, the current state-of-the-art in additive manufacturing does not allow for the creation of single crystal materials due to the nature of the process to be built by sintering or melting a powder substrate to form.

SUMMARY

In one exemplary embodiment, an airfoil for a gas turbine engine extends a span from a root to a tip. The airfoil is provided by a first portion near the root and has a metallic alloy. A third portion near the tip has a refractory material. A second portion joins the first and third portions and has a functional graded material.

In a further embodiment of the above, the span is 0% at the root and 100% at the tip. The metallic alloy is provided from 0% span to about 35-55% span.

In a further embodiment of any of the above, the metallic alloy is a single crystal, directionally solidified, or equiax nickel alloy.

In a further embodiment of any of the above, the span is 0% at the root and 100% at the tip. The functionally graded material is provided from about 35% span to about 75% span.

In a further embodiment of any of the above, the functionally graded material includes nickel alloy and ceramic, cobalt alloy with ceramic or refractory metal with ceramic with progressively more ceramic toward the tip and progressively more metallic alloy toward the root.

In a further embodiment of any of the above, the span is 0% at the root and 100% at the tip. The ceramic is provided from about 55% span to about 100% span.

In a further embodiment of any of the above, the refractory material is a monolithic ceramic, refractory metal or ceramic matrix composite.

In a further embodiment of any of the above, an exterior wall provides an interior cavity that is configured to supply a cooling fluid to the airfoil. An endwall joins the exterior wall to enclose the cavity near the second portion. Radially extending cooling passageways are provided within the exterior wall and are in fluid communication with the interior cavity near the endwall.

In a further embodiment of any of the above, a trailing edge cooling passage is provided between the exterior wall near a trailing edge of the airfoil and exiting at the trailing edge. A plenum is provided in the exterior wall and fluid interconnects the cooling passageways and the trailing edge cooling passage In a further embodiment of any of the above, a trailing edge feed passage is configured to provide cooling fluid to the airfoil. The trailing edge feed passage is fluidly connected to the trailing edge cooling passage near the root.

In a further embodiment of any of the above, the third portion includes a pocket at the tip, and the endwall includes an aperture that fluidly interconnects the interior cavity to the pocket.

In a further embodiment of any of the above, the exterior wall includes film cooling holes that interconnect the cooling passageways to an exterior surface of the exterior wall.

In a further embodiment of any of the above, the interior cavity and the cooling passages are provided in the second portion. The endwall is provided by at least one of the first portion and the second portion.

In a further embodiment of any of the above, the airfoil is a blade.

In another exemplary embodiment, an airfoil for a gas turbine engine extends a span from a root to a tip. An exterior wall provides an interior cavity that is configured to supply a cooling fluid to the airfoil. An endwall joins the exterior wall to enclose the cavity near the second portion. A radially extending cooling passageways is provided within the exterior wall and is in fluid communication with the interior cavity near the endwall. A trailing edge cooling passage is provided between the exterior wall near a trailing edge of the airfoil and exiting at the trailing edge. A plenum is provided in the exterior wall and fluid interconnects the cooling passageways and the trailing edge cooling passage.

In a further embodiment of any of the above, a trailing edge feed passage is configured to provide cooling fluid to the airfoil. The trailing edge feed passage is fluidly connected to the trailing edge cooling passage near the root.

In a further embodiment of any of the above, the third portion includes a pocket at the tip. The endwall includes an aperture that fluidly interconnects the interior cavity to the pocket. The exterior wall includes film cooling holes that interconnect the cooling passageways to an exterior surface of the exterior wall.

In a further embodiment of any of the above, the interior cavity and the cooling passages are provided in the second portion. The endwall is provided by at least one of the first portion and the second portion. The airfoil that is provided by a first portion near the root has a metallic alloy. A third portion near the tip has a refractory material. A second portion joins the first and third portions and has a functional graded material.

In a further embodiment of any of the above, the airfoil is a blade.

In another exemplary embodiment, a method of manufacturing a gas turbine engine component, includes the steps of forming an airfoil that extends a span from a root to a tip. The airfoil is provided by a first portion near the root and has a metallic alloy. A third portion near the tip has a refractory material. A second portion joining the first and third portions has a functional graded material. An exterior wall provides an interior cavity that is configured to supply a cooling fluid to the airfoil. An endwall joins the exterior wall to enclose the cavity near the second portion. Radially extending cooling passageways are provided within the exterior wall and are in fluid communication with the interior cavity near the endwall.

In a further embodiment of the above, the forming step includes additively manufacturing at least one of the second and third portions.

BRIEF DESCRIPTION OF THE DRAWINGS

The disclosure can be further understood by reference to the following detailed description when considered in connection with the accompanying drawings wherein.

Figure 1:
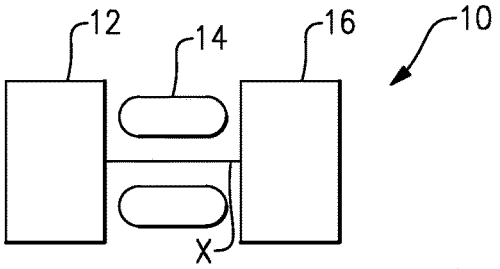
FIG. 1 is a highly schematic view of an example gas turbine engine.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

The disclosed cooling configuration may be used in various gas turbine engine applications. A gas turbine engine 10 uses a compressor section 12 that compresses air. The compressed air is provided to a combustor section 14 where the compressed air and fuel is mixed and burned. The hot combustion gases pass over a turbine section 16, which is rotatable about an axis X with the compressor section 12, to provide work that may be used for thrust or driving another system component.

Many of the engine components, such as blades, vanes (e.g., at 300 in FIG. 4A), combustor and exhaust liners (e.g., at 400 in FIG. 4B), and blade outer air seals (e.g. at 500 in FIG. 5), are subjected to very high temperatures such that cooling may become necessary. The disclosed cooling configuration and manufacturing method may be used for any of these or other gas turbine engine components. For exemplary purposes, one type of turbine blade 20 is described.

Figure 2B:
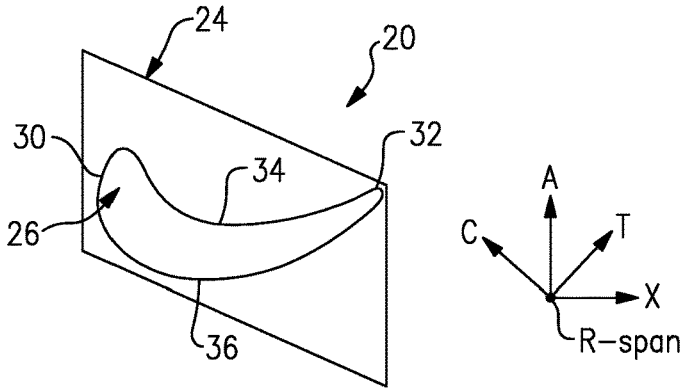
FIG. 2B is a plan view of the airfoil illustrating directional references.
Figure 2A:
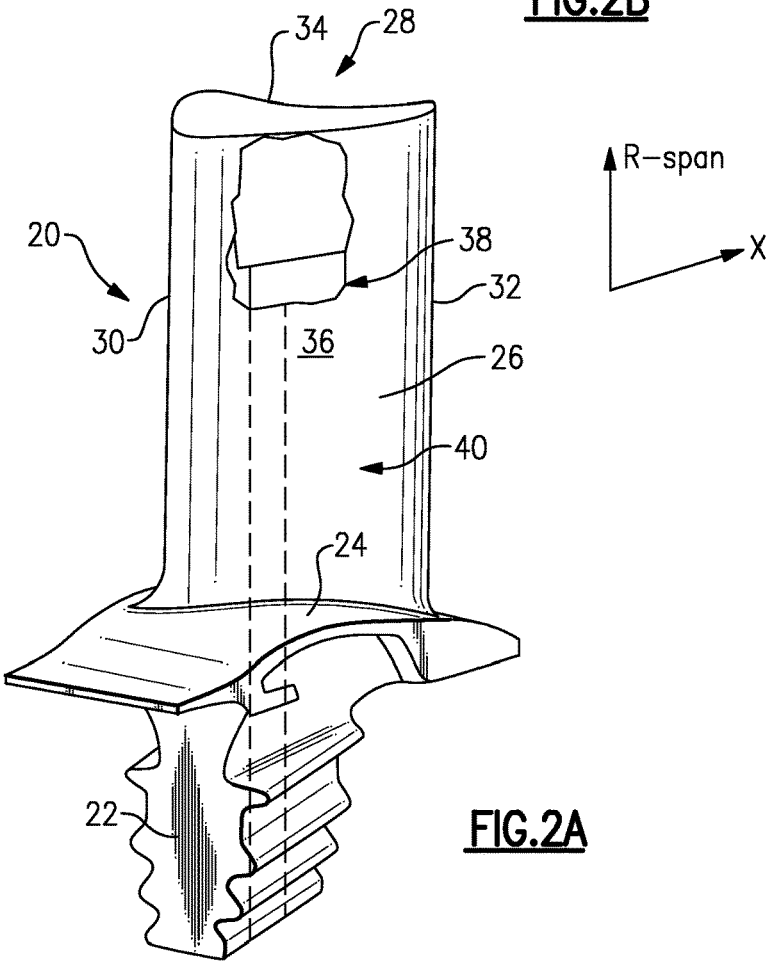
FIG. 2A is a perspective view of the airfoil having the disclosed cooling passage.

Referring to FIGS. 2A and 2B, a root 22 of each turbine blade 20 is mounted to a rotor disk, for example. The turbine blade 20 includes a platform 24, which provides the inner flowpath, supported by the root 22. An airfoil 26 extends in a radial direction R from the platform 24 to a tip 28. It should be understood that the turbine blades may be integrally formed with the rotor such that the roots are eliminated. In such a configuration, the platform is provided by the outer diameter of the rotor. The airfoil 26 provides leading and trailing edges 30, 32. The tip 28 is arranged adjacent to a blade outer air seal.

The airfoil 26 of FIG. 2B somewhat schematically illustrates exterior airfoil surface extending in a chord-wise direction C from a leading edge 30 to a trailing edge 32. The airfoil 26 is provided between pressure (typically concave) and suction (typically convex) wall 34, 36 in an airfoil thickness direction T, which is generally perpendicular to the chord-wise direction C. Multiple turbine blades 20 are arranged circumferentially in a circumferential direction A. The airfoil 26 extends from the platform 24 in the radial direction R, or spanwise, to the tip 28.

The airfoil 18 includes a cooling passage 38 provided between the pressure and suction walls 34, 36. The exterior airfoil surface 40 may include multiple film cooling holes (not shown) in fluid communication with the cooling passage 38.

Figure 5:
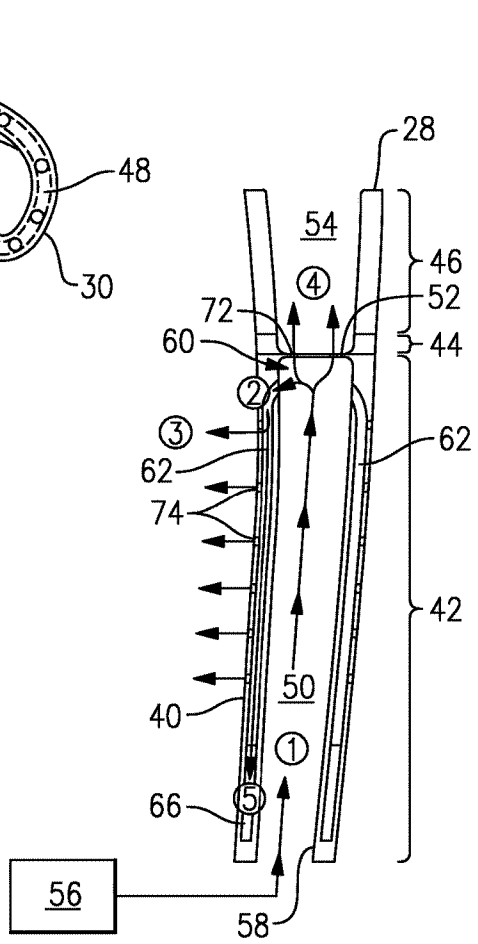
FIG. 5 is a cross-section of the airfoil shown in FIG. 3 taken along line 5-5.
Figure 4:
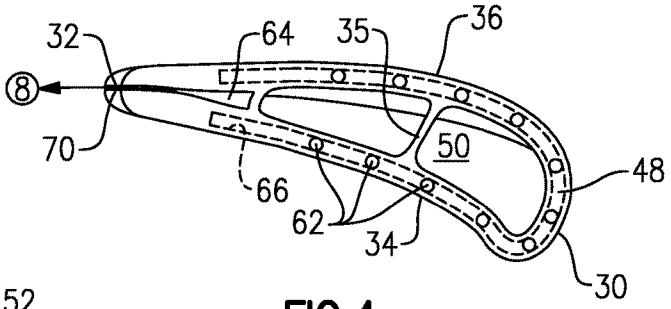
FIG. 4 is a cross-section of the airfoil shown in FIG. 3 taken along line 4-4.
Figure 3:
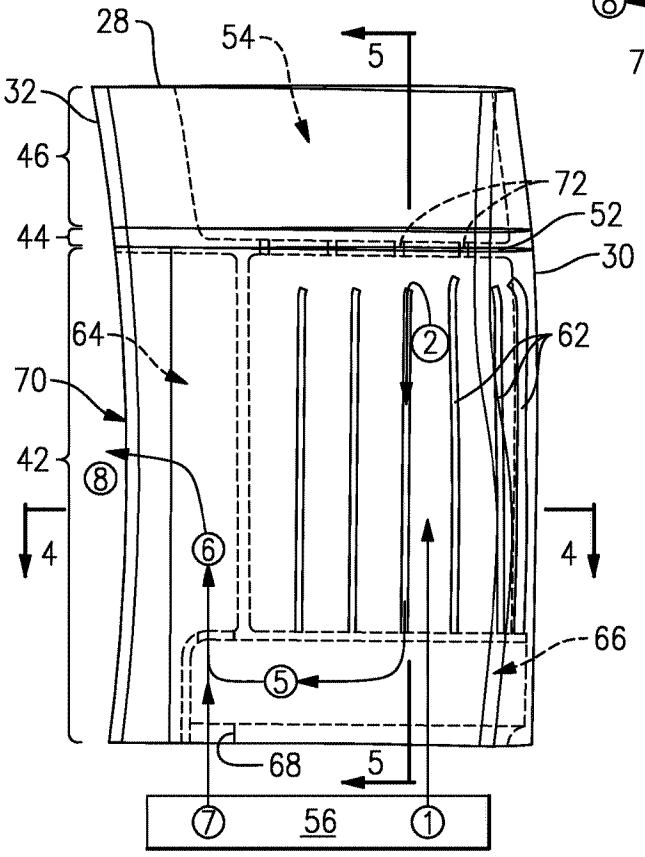
FIG. 3 is a schematic view depicting example cooling passages within an airfoil.

Referring to FIGS. 3-5, the airfoil 26 extends from a root at the platform 24 to the tip 28. The airfoil at the root is referred to as the 0% span position and the tip 28 is referred to as the 100% span position. The airfoil 26 is provided by a first portion near the root having a metallic alloy, a third portion 46 near the tip 28 having a refractory material, and a second portion 44 joining the first and third portions 42, 46. The second portion has a functionally grated material (FGM).

In one example, the metallic alloy of the first portion 42 is provided from the 0% span position to about 35-55% span. The metallic alloy is a single crystal, directionally solidified, or equiax nickel alloy. Manufacturing the airfoil with a significant amount of refractory material may reduce the pull forces on the airfoil to a degree where using a lower strength material is possible, such as an equiax material. One example equiax nickel alloy is MAR-M-247® available from MetalTek International.

The third portion 46 extends from about 55% span to about 100% span. In one example, the refractory material is provided by a monolithic ceramic, such as silicon nitride, or a refractory metal or ceramic matrix composite.

The second portion 44 is provided from about 35% span to about 75% span by a nanostructured functionally graded material to join the first and third portions 42, 46 to one another. The FGM includes a variation in composition and structure gradually over volume, resulting in corresponding changes in the properties of the material for specific function and applications. The FGM includes nickel alloy and ceramic, cobalt alloy with ceramic or refractory metal with ceramic, with progressively more ceramic toward the tip and progressively more metallic alloy toward the root. Various approaches based on the bulk (particulate processing), preform processing, layer processing and melt processing are used to fabricate the FGM, such as electron beam powder metallurgy technology, vapor deposition, laser spray deposition, electrochemical deposition, electro discharge compaction, plasma-activated sintering, shock consolidation, hot isostatic pressing, Sulzer high vacuum plasma spray, for example. A gradient mixing algorithm may be used to tailor the transition from the first portion 42 to the third portion 46.

An exterior wall 48, which provides the pressure and suction side walls 34, 36, defines an interior cavity 50 that extends from an inlet 58 near the root to an end 60. One or more ribs 35 may be used to connect the pressure and suction side walls 34, 36 for strength. An endwall 52 joins the exterior wall 48 to enclose the interior cavity 50 near the second portion 44. The interior cavity 50 may include a variety of cooling features such as protrusions, recesses and/or turbulators, if desired. In the example, the endwall 52 is provided by both the first and second portions 42, 44, although the endwall may be provided by only one of the first and second portions if desired.

Radially extending cooling passageways 62 are provided within the exterior wall 48 and are in fluid communication with the interior cavity near the endwall 52. The cooling passageways 62 provide microchannels that keep the exterior wall 48 super-cooled. The cooling passageways 62 extend from the end 60 to a plenum 66 provided in the exterior wall 48.

The plenum 66 fluidly interconnects to a trailing edge cooling passage 64 provided in a trailing edge portion of the airfoil 26. A trailing edge feed passage 68 is fluidly interconnected to the plenum 66 and supplements the cooling fluid provided to the trailing edge cooling passage 64. The trailing edge cooling passage 64 includes an exit 70 provided along the trailing edge 32.

Apertures 72 fluidly interconnect the interior cavity 50 to a pocket 54 provided in the third portion 46.

Film cooling holes 74 fluidly interconnect the cooling passageways 62 to the exterior airfoil surface 40.

The flow of fluid is indicated by the arrows in FIGS. 3-5 and circled numerals relating to locations along the cooling network. Cooling fluid from a cooling source 56, such as compressor bleed air, is provided to the inlet 58 of the interior cavity 50, as indicated at location 1. Fluid flows radially outwardly from location 1 toward the end 60 at location 2. Cooling fluid from location 2 flows into the pockets 54 through aperture 72 to purge hot gases from the pocket 54. Fluid flows into the cooling passageways 62, some of which exit through the film cooling holes 74, as indicated at location 3.

Cooling fluid flows radially inwardly along the cooling passageways 62 and into the plenum 66, as indicated at location 5. Fluid within the plenum 66 is supplemented by trailing edge feed passage 68 from location 7 to provide cooling fluid to the trailing edge cooling passage 64, as indicate at location 6. Cooling fluid within the trailing edge cooling passage 64 flows out of exit 70, as indicated at location 8.

Flow from the plenum 66 is heavily metered such that pressure within the trailing edge cooling passage 64 offers a desirable heat sink to the cooling passageway 62. The plenum pressure within the cooling passageway 62 is such that its lowest static pressure is still higher than the highest stagnation pressure along the airfoil 26. This ensures that if the airfoil 26 ever encounters foreign object debris, the hole created in the exterior wall 48 to the cooling passageway 62 stays outflowing.

In further help isolating the conduction from the hot ceramic tip to the metal inner portion of the blade, apertures 72 are built into the pocket 54 cutting the heat flux conduction between the two areas.

The cooling configuration employs relatively complex geometry that may not be formed easily by traditional casting methods. To this end, additive manufacturing techniques may be used in a variety of ways to manufacture gas turbine engine component, such as an airfoil, with the disclosed cooling configuration. The structure can be additively manufactured directly within a powder-bed additive machine (such as an EOS 280). The first portion 42 can be cast and the second and third portions 44, 46 can be additively manufactured. Alternatively, cores that provide the structure shape of the first portion 42 can be additively manufactured. Such a core could be constructed using a variety of processes such as photo-polymerized ceramic, electron beam melted powder refractory metal, or injected ceramic based on an additively built disposable core die. The core and/or shell molds for the first portion 42 are first produced using a layer-based additive process such as LAMP from Renaissance Systems. Further, the core could be made alone by utilizing EBM of molybdenum powder in a powder-bed manufacturing system.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. An airfoil for a gas turbine engine comprising:

the airfoil extending a span from a root to a tip, the airfoil provided by a first portion near the root having a metallic alloy, a third portion near the tip having a refractory material, and second portion joining the first and third portions and having a functionally graded material, wherein the span is 0% at the root and 100% at the tip, the functionally graded material provided from 35% span to 75% span.

2. The airfoil according to claim 1, wherein the functionally graded material includes nickel alloy and ceramic, cobalt alloy with ceramic, or refractory metal with ceramic, with progressively more ceramic toward the tip.

3. An airfoil for a gas turbine engine comprising:

the airfoil extending a span from a root to a tip, the airfoil provided by a first portion near the root having a metallic alloy, a third portion near the tip having a refractory material, and second portion joining the first and third portions and having a functionally graded material, wherein the span is 0% at the root and 100% at the tip, the refractory material provided from 55% span to 100% span.

4. The airfoil according to claim 3, wherein the span is 0% at the root and 100% at the tip, the metallic alloy provided from 0% span to between 35 and less than 55% span.

5. The airfoil according to claim 4, wherein the metallic alloy is a single crystal, directionally solidified, or equiax nickel alloy.

6. The airfoil according to claim 3, wherein the refractory material is a monolithic ceramic, refractory metal, or ceramic matrix composite.

7. An airfoil for a gas turbine engine comprising:

the airfoil extending a span from a root to a tip, the airfoil provided by a first portion near the root having a metallic alloy, a third portion near the tip having a refractory material, and second portion joining the first and third portions and having a functionally graded material, wherein an exterior wall provides an exterior airfoil surface and circumscribes an interior cavity configured to supply a cooling fluid to the airfoil, an endwall joining the exterior wall to enclose the cavity near the second portion, and radially extending cooling passageways provided within the exterior wall between the interior cavity and the exterior airfoil surface, the cooling passageways in fluid communication with the interior cavity near the endwall.

8. The airfoil according to claim 7, wherein a trailing edge cooling passage is provided between the exterior wall near a trailing edge of the airfoil and exiting at the trailing edge, a plenum is provided in the exterior wall and fluid interconnects the cooling passageways and the trailing edge cooling passage.

9. The airfoil according to claim 8, wherein a trailing edge feed passage is configured to provide cooling fluid to the airfoil, the trailing edge feed passage is fluidly connected to the trailing edge cooling passage near the root.

10. The airfoil according to claim 7, wherein the third portion includes a pocket at the tip, and the endwall includes an aperture fluidly interconnecting the interior cavity to the pocket.

11. The airfoil according to claim 7, wherein the exterior wall includes film cooling holes interconnecting the cooling passageways to the exterior airfoil surface of the exterior wall.

12. The airfoil according to claim 7, wherein the interior cavity and the cooling passages are provided in the second portion, and the endwall is provided by at least one of the first portion and the second portion.

13. The airfoil according to claim 7, wherein the airfoil is a blade.

14. An airfoil for a gas turbine engine comprising:

an airfoil extending a span from a root to a tip, an exterior wall provides an exterior airfoil surface and circumscribes an interior cavity configured to supply a cooling fluid to the airfoil, an endwall joining the exterior wall to enclose the cavity and radially extending cooling passageways provided within the exterior wall and in fluid communication with the interior cavity near the endwall, wherein a trailing edge cooling passage is provided between the exterior wall near a trailing edge of the airfoil and exiting at the trailing edge, a plenum is provided in the exterior wall between the interior cavity and the exterior airfoil surface, the cooling passageways fluid interconnects the cooling passageways and the trailing edge cooling passage.

15. The airfoil according to claim 14, wherein a trailing edge feed passage is configured to provide cooling fluid to the airfoil, the trailing edge feed passage is fluidly connected to the trailing edge cooling passage near the root.

16. The airfoil according to claim 14, wherein a third portion includes a pocket at the tip, and the endwall includes an aperture fluidly interconnecting the interior cavity to the pocket, and the exterior wall includes film cooling holes interconnecting the cooling passageways to the exterior airfoil surface of the exterior wall.

* * * * *